US012799832B2

(12) United States Patent
Denson

(10) Patent No.: US 12,799,832 B2
(45) Date of Patent: Nov. 17, 2026

(54) HOSE RETENTION SYSTEM

(71) Applicant: Caterpillar Global Mining Equipment LLC, Denison, TX (US)

(72) Inventor: David Micheal Denson, Nanmangalam (IN)

(73) Assignee: Caterpillar Global Mining Equipment LLC., Denison, TX (US)

( * ) Notice: Subject to any disclaimer, the term of this patent is extended or adjusted under 35 U.S.C. 154(b) by 82 days.

(21) Appl. No.: 18/912,962

(22) Filed: Oct. 11, 2024

(65) Prior Publication Data

US 2025/0122767 A1 Apr. 17, 2025

(30) Foreign Application Priority Data

Oct. 12, 2023 (AU) ..... 2023248133

(51) Int. Cl.
*E21B 19/02* (2006.01)

(52) U.S. Cl.
CPC ..... *E21B 19/02* (2013.01)

(58) Field of Classification Search
CPC ..... E21B 19/02; F16L 3/1218; F16L 3/1203; F16L 3/22; F16L 3/1075; F16L 3/1215; F16M 2200/021; F16M 2200/024
USPC ..... 248/70, 51–52, 528, 533, 136, 150
See application file for complete search history.

(56) References Cited

U.S. PATENT DOCUMENTS

| | | | | |
|---|---|---|---|---|
| 5,383,318 | A * | 1/1995 | Kelley | H02G 3/288 52/287.1 |
| 5,588,166 | A * | 12/1996 | Burnett | F16L 3/1075 5/503.1 |
| 6,112,834 | A | 9/2000 | Barrett | |
| 6,196,503 | B1 * | 3/2001 | Cernosek | F16L 3/00 248/231.51 |
| 6,776,379 | B2 * | 8/2004 | Sherer | B25H 3/02 248/152 |
| 8,827,008 | B2 | 9/2014 | Hankins et al. | |
| 11,319,808 | B2 * | 5/2022 | Gonzalez | F16L 3/01 |
| 2006/0027712 | A1 * | 2/2006 | Carrera | F16L 3/127 248/49 |
| 2014/0367529 | A1 * | 12/2014 | Choi | F16L 3/01 248/68.1 |

FOREIGN PATENT DOCUMENTS

WO 2019104369 A1 6/2019

* cited by examiner

*Primary Examiner* — Christopher Garft

(57) ABSTRACT

A hose retention system for a machine includes a bracket assembly defining a central opening. The hose retention system also includes a gate coupled to the bracket assembly and being movable between a closed position and an open position. The gate is disposed in the open position to allow passage of one or more hoses of the machine through the central opening of the bracket assembly. The gate is movable in any one of a clockwise direction and an anti-clockwise direction. The hose retention system includes at least one gate locking pin coupled to the bracket assembly that is movable between a locked state to prevent a movement of the gate to the open position and an unlocked state. In the unlocked state, the at least one gate locking pin allows a movement of the gate to the open position.

19 Claims, 7 Drawing Sheets

HOSE RETENTION SYSTEM

CROSS-REFERENCE TO RELATED APPLICATION

This application claims priority under 35 USC § 119 and the Paris Convention to Australian Patent Application 2023248133 filed on Oct. 12, 2023.

TECHNICAL FIELD

The present disclosure relates to a hose retention system, a hose assembly including the hose retention system, and a machine including the hose retention system.

BACKGROUND

A drilling machine typically includes a vertical mast and a drill motor that moves up and down relative to the mast. The drill motor is a hydraulic motor. Supplying hydraulic fluid to the drill motor is accomplished by long hoses that move along with the drill motor. Further, drill pipes used in drilling operations are supplied with compressed high-pressure air through long hoses. Such hoses used for supplying the hydraulic fluid and the compressed high-pressure air are unclamped along their length due to which the hoses are free to move/oscillate during drilling operations.

Currently, a hose cage is provided to limit the movement of the hoses. However, the hose cage encloses the hoses only on three sides. During high velocity winds and/or turbulent operating conditions, the hoses tend to come out of the hose cage from an open side of the hose cage. In some instances, the hoses may engage with mast weldment or other components of the machine, which may cause the hoses to rupture. The hoses may also cause damage to one or more components of the machine. Any damage to the hoses or the components of the machine may halt the drilling operation, may increase machine downtime, and may increase maintenance costs, which is not desirable.

U.S. Pat. No. 11,319,808 describes a hose retention system for a negative-angle-capable blasthole drilling machine. The hose retention system may include an upper cage to extend longitudinally along a mast structure. The upper cage may have a secured end to couple the upper cage to the mast structure, a free end to extend toward the mast structure, and a first longitudinally-extending channel. The hose retention system may include a lower cage separate from the upper cage to extend longitudinally along the mast structure. The lower cage may have a secured end to couple the lower cage to the mast structure, a free end to extend toward the mast structure, and a second longitudinally-extending channel.

SUMMARY OF THE DISCLOSURE

In an aspect of the present disclosure, a hose retention system for a machine. The hose retention system includes a bracket assembly defining a first end, a second end opposite the first end, and a central opening. The hose retention system also includes a gate coupled to the bracket assembly at the first end of the bracket assembly. The gate is movable between a closed position and an open position. The gate is disposed in the open position to allow passage of one or more hoses of the machine through the central opening of the bracket assembly. Further, to be disposed in the open position, the gate is movable in any one of a clockwise direction and an anti-clockwise direction. The hose retention system further includes at least one gate locking pin coupled to the bracket assembly. The at least one gate locking pin is movable between a locked state and an unlocked state. In the locked state, the at least one gate locking pin prevents a movement of the gate to the open position. In the unlocked state, the at least one gate locking pin allows a movement of the gate to the open position.

In another aspect of the present disclosure, a hose assembly for a machine. The hose assembly includes a hose bracket. The hose assembly also includes a gate opening plate coupled to the hose bracket. The hose assembly further includes one or more hoses coupled to the hose bracket. The hose assembly includes at least one hose retention system. The at least one hose retention system includes a bracket assembly defining a first end, a second end opposite the first end, and a central opening. The at least one hose retention system also includes a gate coupled to the bracket assembly at the first end of the bracket assembly. The gate is movable between a closed position and an open position. The gate is disposed in the open position to allow passage of the one or more hoses through the central opening of the bracket assembly. Further, to be disposed in the open position, the gate is movable in any one of a clockwise direction and an anti-clockwise direction. The at least one hose retention system further includes at least one gate locking pin coupled to the bracket assembly. The at least one gate locking pin is movable between a locked state and an unlocked state. In the locked state, the at least one gate locking pin prevents a movement of the gate to the open position. In the unlocked state, the at least one gate locking pin allows a movement of the gate to the open position. The gate opening plate engages with the each of the at least one gate locking pin to move the at least one gate locking pin to the unlocked state, and the gate to move the gate to the open position.

In yet another aspect of the present disclosure, a machine is provided. The machine includes a mast assembly. The machine also includes one or more hoses coupled to the mast assembly. The machine further includes at least one hose retention system coupled to and extending from the mast assembly. The at least one hose retention system includes a bracket assembly defining a first end, a second end opposite the first end, and a central opening. The at least one hose retention system also includes a gate coupled to the bracket assembly at the first end of the bracket assembly. The gate is movable between a closed position and an open position. The gate is disposed in the open position to allow passage of the one or more hoses through the central opening of the bracket assembly. Further, to be disposed in the open position, the gate is movable in any one of a clockwise direction and an anti-clockwise direction. The at least one hose retention system further includes at least one gate locking pin coupled to the bracket assembly, wherein the at least one gate locking pin is movable between a locked state and an unlocked state, wherein, in the locked state, the at least one gate locking pin prevents a movement of the gate to the open position, and wherein, in the unlocked state, the at least one gate locking pin allows a movement of the gate to the open position.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
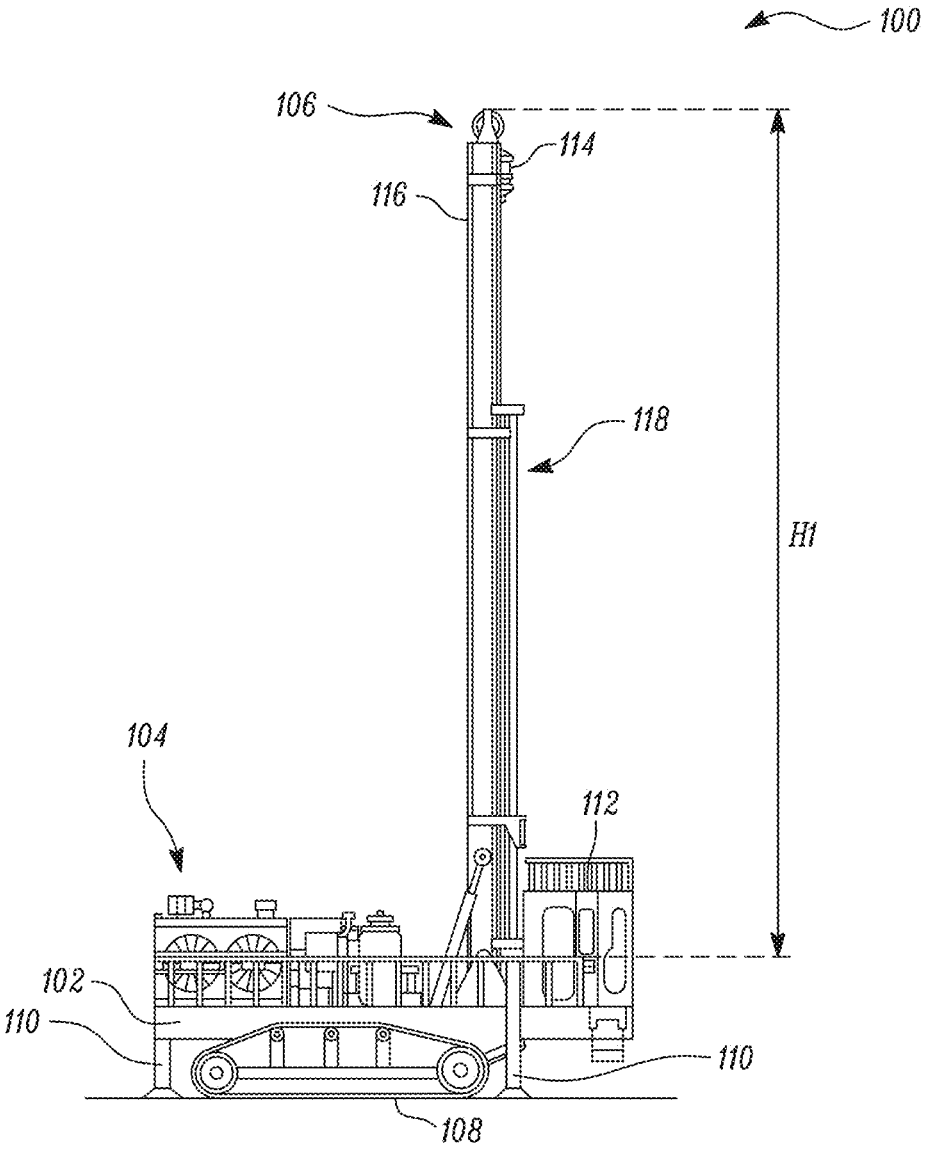
FIG. 1 is a schematic side view of a machine, according to an example of the present disclosure.

FIG. 1 illustrates a schematic side view of an exemplary machine 100. In the illustrated embodiment of FIG. 1, the machine 100 is a blast hole drilling machine. However, the machine 100 may embody any other type of drilling machine or any off-highway machine including hoses or cables, without any limitations.

As shown in FIG. 1, the machine 100 includes a frame 102. The machine 100 also includes machinery 104. Further, the machine 100 includes a mast assembly 106 supported by the frame 102. The mast assembly 106 extends along a height H1. The frame 102 may be supported on a ground surface by a transport mechanism, such as, crawler tracks 108. The crawler tracks 108 may allow the machine 100 to maneuver on the ground surface to a desired location for drilling operations. The frame 102 further includes one or more jacks 110 for supporting and leveling the machine 100 on the ground surface during drilling operations. The frame 102 may support the machinery 104, which may include various components (not shown herein), such as, a power source (such as, one or more engines or batter modules), motors, batteries, pumps, air compressors, and/or any other equipment necessary to power and operate the machine 100. The frame 102 further supports an operator cab 112, from which an operator may maneuver and control the machine 100.

The mast assembly 106 includes a rotary drill head 114. The rotary drill head 114 may be supported on a mast frame 116 of the mast assembly 106. Further, the machine 100 may include one or more drill motors (not shown) associated with the rotary drill head 114. The drill motor may include a hydraulic motor. The drill head 114 moves up and down relative to the mast frame 116.

The machine 100 also includes a pipe rack 118 mounted on the mast assembly 106, as shown schematically in FIG. 1. The pipe rack 118 includes one or more drill pipes (not shown herein). The pipe rack 118 may swing in and swing out of a drill center for feeding drill pipes (not shown) to the rotary drill head 114 and retrieving them back. The rotary drill head 114 may couple to, and rotate, the one or more drill pipes for performing the drilling operation.

The machine 100 includes one or more hoses 120, 122 (shown in FIG. 2A) coupled to the mast assembly 106. Specifically, the one or more hoses 120, 122 include one or more first hoses 120 that supply hydraulic fluid to the drill motor. The first hoses 120 move along with the drill head 114 along the mast frame 116. Further, the one or more hoses 120, 122 include one or more second hoses 122 that supply compressed high-pressure air to the drill pipes. The first and second hoses 120, 122 are unclamped along their length due to which the hoses 120, 122 are free to move/oscillate during drilling operations.

Figure 2A:
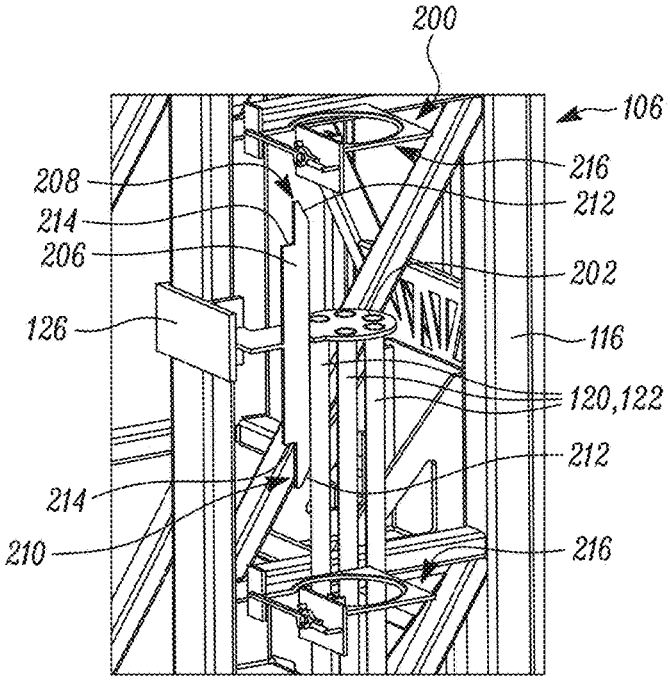
FIG. 2A is a schematic perspective view of a hose assembly for the machine of FIG. 1, according to an example of the present disclosure.

Referring to FIG. 2A, the present disclosure relates to a hose assembly 200 for the machine 100. The hose assembly 200 includes a hose bracket 202. The hose assembly 200 also includes the one or more hoses 120, 122 coupled to the hose bracket 202. The hose bracket 202 holds the one or more hoses 120, 122. Further, the hose assembly 200 includes a gate opening plate 206 coupled to the hose bracket 202. In some examples, the gate opening plate 206 may be welded to the hose bracket 202. The gate opening plate 206 moves along the height H1 (see FIG. 1) of the mast assembly 106. Further, the hose bracket 202 and the gate opening plate 206 are connected to the mast frame 116 by a connecting bracket 126. The connecting bracket 126 forms a part of the rotary drill head 114 (see FIG. 1), and the drill motor is also coupled to the connecting bracket 126. The connecting bracket 126 is movable along the mast assembly 106, which in turn causes the hose bracket 202 and the gate opening plate 206 to move along the height H1 of the mast assembly 106. The gate opening plate 206 defines a pair of opposing ends 208, 210. Further, the gate opening plate 206 defines a wedge surface 212 and a cut-out 214 at each opposing end 208, 210. Specifically, the gate opening plate 206 defines the wedge surface 212 and the cut-out 214 at the end 208 and the gate opening plate 206 defines the wedge surface 212 and the cut-out 214 at the end 210.

Figure 2B:
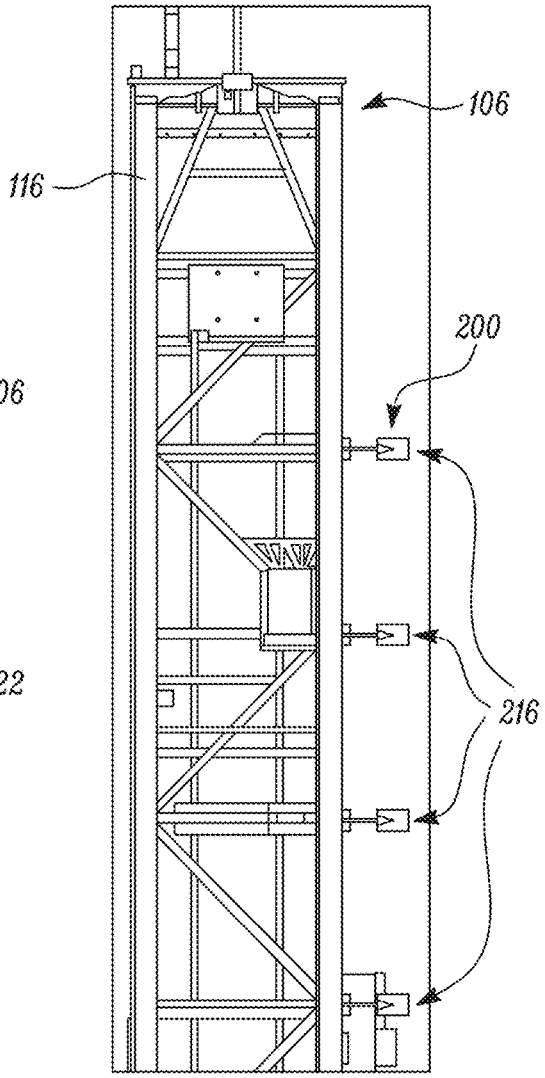
FIG. 2B is a schematic side view of a mast assembly including a number of hose retention systems associated with the hose assembly of FIG. 2A, according to an example of the present disclosure.

Further, the hose assembly 200 includes one or more hose retention systems 216 coupled to and extending from the mast assembly 106. In some examples, the one or more hose retention systems 216 may be welded to the mast frame 116. As shown in FIG. 2B, the hose assembly 200 includes the number of hose retention systems 216 spaced apart from each other along the height H1 (see FIG. 1) of the mast assembly 106. The number of hose retention systems 216 are in alignment with each other. Although only four hose retention systems 216 are illustrated in FIG. 2B, it may be contemplated that the hose assembly 200 may include any number of hose retention systems 216 based on the height H1 of the mast assembly 106.

Figure 3A:
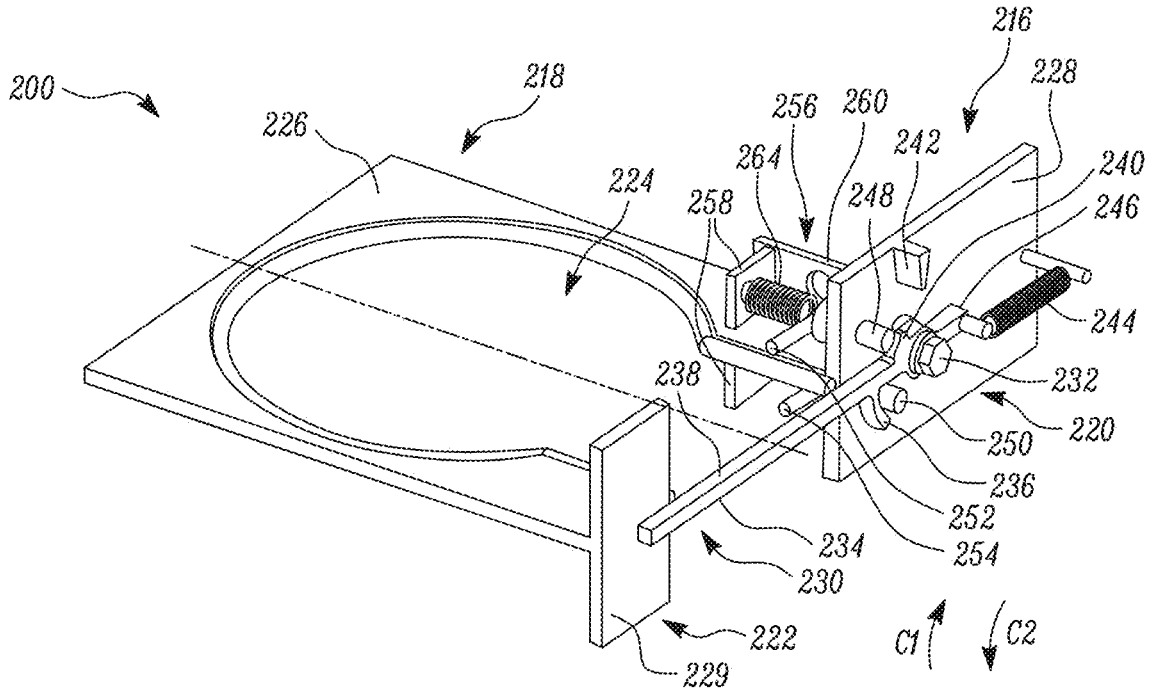
FIG. 3A is a schematic perspective view of the hose retention system of FIG. 2A, according to an example of the present disclosure.

Referring now to FIG. 3A, the hose retention system 216 includes a bracket assembly 218 defining a first end 220, a second end 222 opposite the first end 220, and a central opening 224. The bracket assembly 218 includes a hose retention member 226 defining the central opening 224. Specifically, the hose retention member 226 includes a substantially rectangular plate defining the central opening 224 therein. The bracket assembly 218 also includes a plate 228 coupled to the hose retention member 226 at the first end 220 of the bracket assembly 218. The plate 228 extends orthogonally relative to the hose retention member 226. The plate 228 will be hereinafter interchangeably referred to as a first plate 228. The bracket assembly 218 includes a second plate 229 coupled to the hose retention member 226 at the second end 222 of the bracket assembly 218. The second plate 229 and a portion of the hose retention member 226 disposed at the second end 222 together facilitate coupling of the hose retention system 216 with the mast frame 116 (see FIGS. 2A and 2B). Further, the first and second plates 228, 229 may be coupled to the hose retention member 226 by welding or any other joining technique known in the art.

Figure 5:
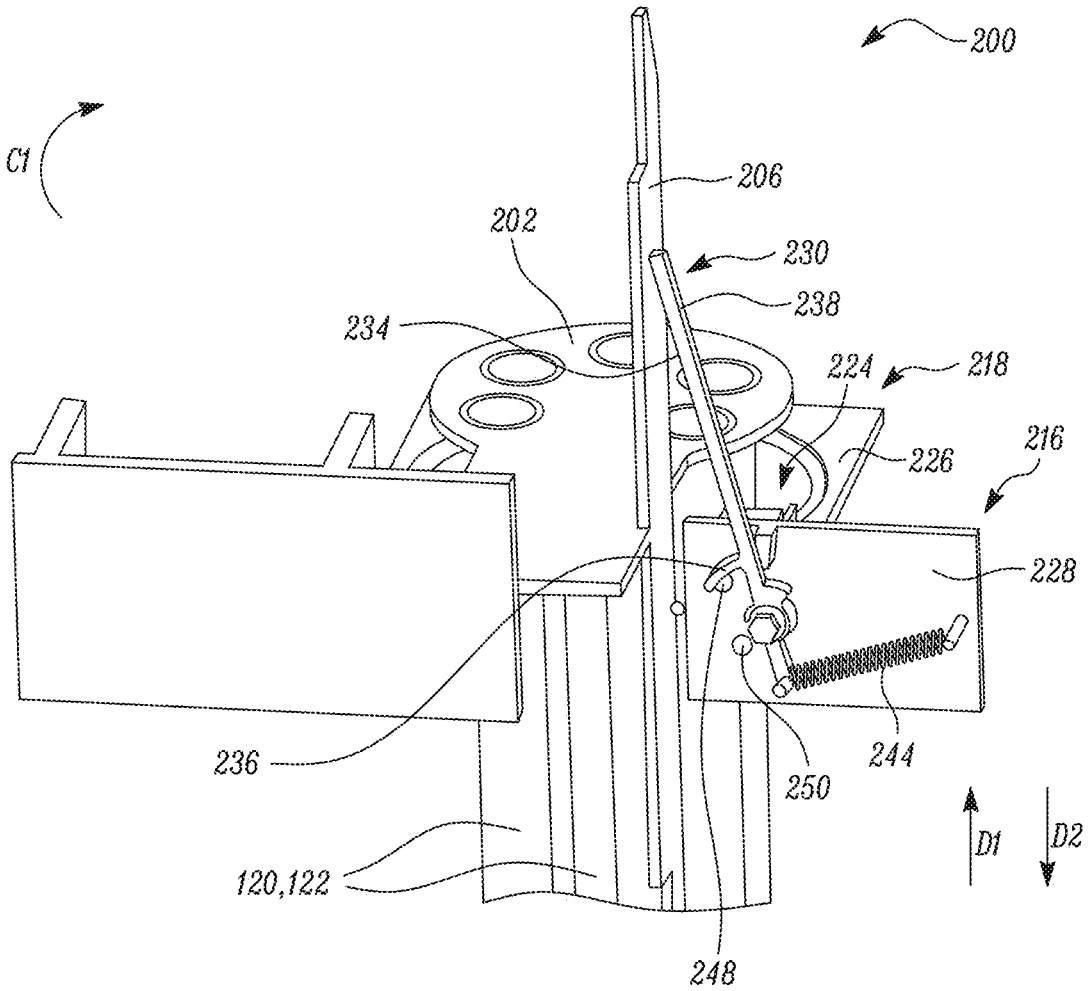
FIG. 5 is a schematic perspective view illustrating a gate of the hose retention system of FIG. 3A in an open position based on a movement of the gate in a clockwise direction.

The hose retention system 216 also includes a gate 230 coupled to the bracket assembly 218 at the first end 220 of the bracket assembly 218. The gate 230 is rotatably coupled to the first plate 228 of the bracket assembly 218. The gate 230 is rotatable relative to the second plate 229 in a clockwise direction C1 and an anti-clockwise direction C2. Further, the gate 230 is coupled to the first plate 228 by a mechanical fastener 232. The mechanical fastener 232 may include a bolt or a pin. The gate 230 is movable between a closed position (as shown in FIG. 3A) and an open position (as shown in FIG. 5). The gate 230 is disposed in the open position to allow passage of the one or more hoses 120, 122 (see FIG. 2) of the machine 100 (see FIG. 1) through the central opening 224 of the bracket assembly 218. Further, to be disposed in the open position, the gate 230 is movable in the clockwise direction C1 and/or the anti-clockwise direction C2.

The gate 230 includes a first surface 234. The gate 230 also includes a first projection 236 extending from the first surface 234 of the plate 228. The gate 230 further includes a second surface 238 opposite the first surface 234. The gate 230 includes a second projection 240 extending from the second surface 238 of the plate 228.

The hose retention system 216 further includes a stopper 242 coupled to the plate 228 to prevent a movement of the gate 230 beyond a predetermined angular distance in each of the clockwise direction C1 and the anti-clockwise direction C2. The stopper 242 engages with the second surface 238 of the gate 230 to prevent the movement of the gate 230 beyond the predetermined angular distance in each of the clockwise direction C1 and the anti-clockwise direction C2.

The hose retention system 216 includes a first spring member 244 disposed between the plate 228 and one end 246 of the gate 230 to bias the gate 230 to the closed position. Specifically, in an extended state, the first spring member 244 biases the gate 230 to the close position. Further, the first spring member 244 moves to an extended state, when the gate 230 moves towards the open position.

Figure 3B:
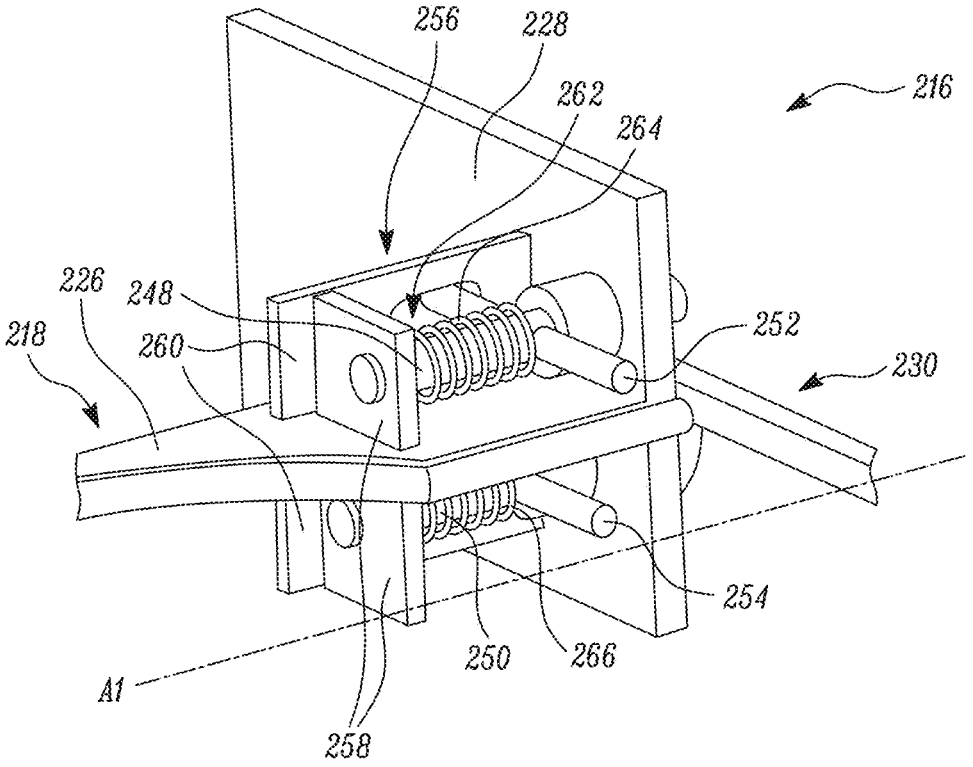
FIG. 3B is a schematic perspective view illustrating gate locking pins associated with the hose retention system of FIG. 3A.

Referring now to FIG. 3B, the hose retention system 216 includes one or more gate locking pins 248, 250 coupled to the bracket assembly 218. The one or more gate locking pins 248, 250 are movable between a locked state (as shown in the accompanying FIG. 3B) and an unlocked state (as shown in FIG. 4B). In the locked state, the one or more gate locking pins 248, 250 prevent a movement of the gate 230 to the open position. In the unlocked state, the one or more gate locking pins 248, 250 allow a movement of the gate 230 to the open position. In the illustrated example of FIG. 3B, the one or more gate locking pins 248, 250 include a first gate locking pin 248. Further, the hose retention system 216 includes a first bar member 252 coupled to the first gate locking pin 248. The one or more gate locking pins 248, 250 further include a second gate locking pin 250 disposed parallel to the first gate locking pin 248. Further, the hose retention system 216 includes a second bar member 254 coupled to the second gate locking pin 250.

As shown in FIG. 3B, the bracket assembly 218 includes an L-shaped structure 256 connected to the plate 228 and the hose retention member 226. The structure 256 includes a pair of first members 258 and a pair of second members 260 disposed orthogonally to the pair of first members 258. Each second member 260 defines a corresponding slot 262. The first gate locking pin 248 is at least partially received within the first member 258 and the first plate 228 such that the first gate locking pin 248 is slidable along an axis A1. Further, the first bar member 252 is movable within the slot 262 during the movement of the first gate locking pin 248 between the locked state and the unlocked state. Moreover, the second gate locking pin 250 is at least partially received within the first member 258 and the first plate 228 such that the second gate locking pin 250 is slidable along the axis A1. Further, the second bar member 254 is movable within the slot 262 during the movement of the second gate locking pin 250 between the locked state and the unlocked state.

The hose retention system 216 also includes one or more second spring members 264, 266 coupled to the one or more gate locking pins 248, 250 to bias the one or more gate locking pins 248, 250 to the locked state. It should be noted that, in an extended state, the second spring members 264, 266 bias the corresponding gate locking pin 248, 250 to the locked state. Moreover, the second spring members 264, 266 move to a compressed state when the corresponding gate locking pin 248, 250 moves towards the unlocked state. The one or more second spring members 264, 266 include two second spring members 264, 266 herein. The second spring member 264 is disposed around the first gate locking pin 248. Further, the second spring member 264 extends along the axis A1 and is connected to each of the first member 258 and the first bar member 252. The second spring member 264 compresses during the sliding of the first bar member 252 towards the first member 258. Moreover, the second spring member 266 is disposed around the second gate locking pin 250. Further, the second spring member 266 extends along the axis A1 and is connected to the first member 258 and the second bar member 254. The second spring member 266 compresses during the sliding of the second bar member 254 towards the first member 258.

Referring now to FIGS. 3A and 3B, when the first gate locking pin 248 is in the locked state, a portion of the first gate locking pin 248 projects from the plate 228 to prevent the gate 230 from moving in the clockwise direction C1. Further, the first gate locking pin 248 is in the unlocked state, the first gate locking pin 248 slides inwards, i.e., towards the first member 258, along the axis A1 to allow the gate 230 to move in the clockwise direction C1. Similarly, when the second gate locking pin 250 is in the locked state, a portion of the second gate locking pin 250 projects from the plate 228 to prevent the gate 230 from moving in the anti-clockwise direction C2. Further, when the second gate locking pin 250 is in the unlocked state, the second gate locking pin 250 slides inwards, i.e., towards the first member 258, along the axis A1 to allow the gate 230 to move in the anti-clockwise direction C2.

Figure 4A:
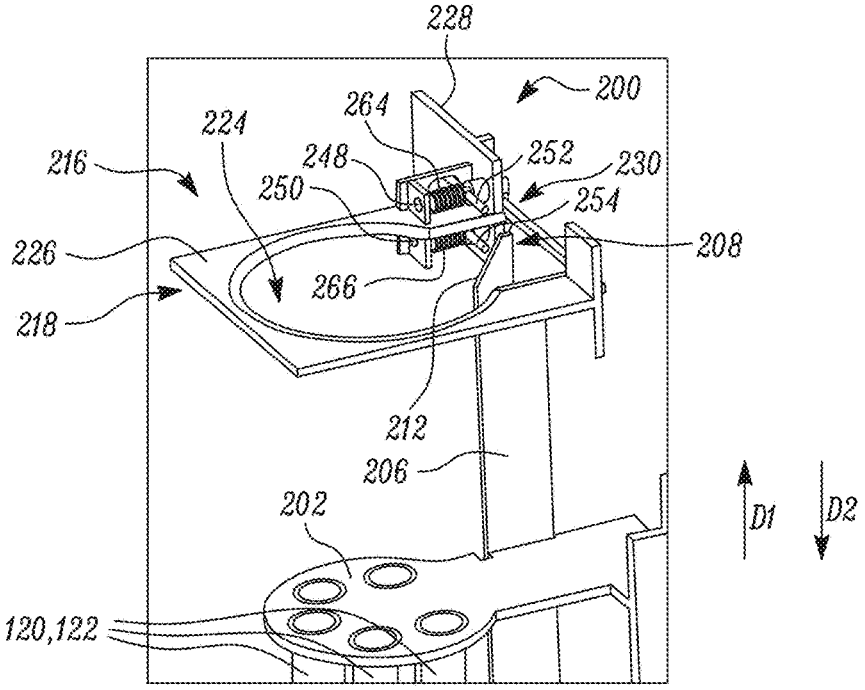
FIGS. 4A and 4B are schematic perspective views illustrating a contact of a gate opening plate with the hose retention system of FIG. 3A during an upward movement of the gate opening plate.
Figure 4B:
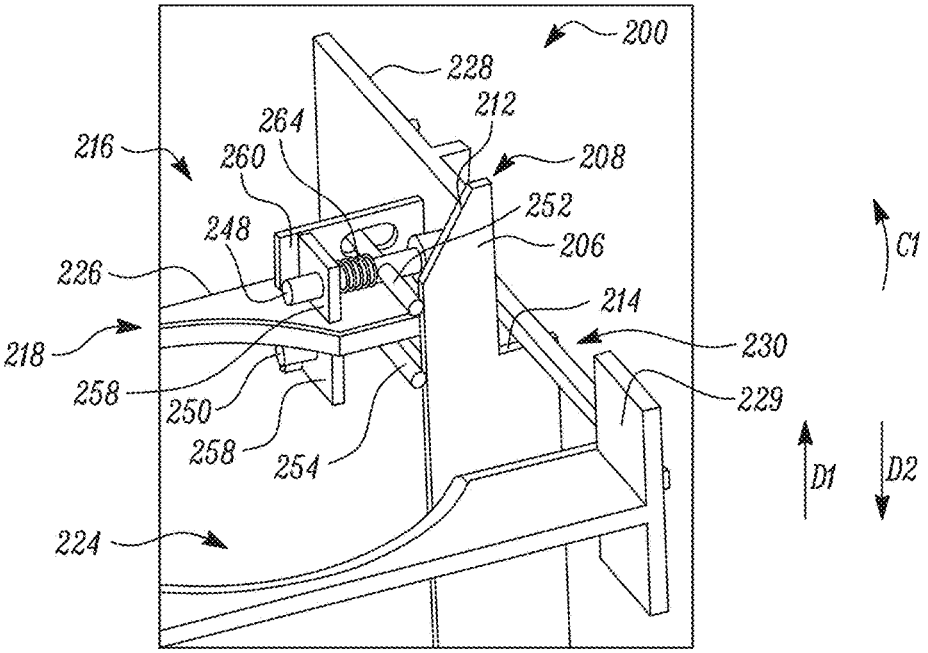

Referring now to FIGS. 4A and 4B, the hose bracket 202 and the gate opening plate 206 are movable along the height H1 (see FIG. 1) of the mast assembly 106 (see FIG. 1) in an upward direction D1 and a downward direction D2. Further, the gate opening plate 206 engages with each of the one or more gate locking pins 248, 250 to move the one or more gate locking pins 248, 250 to the unlocked state, and the gate 230 to move the gate 230 to the open position. Specifically, during the movement of the hose bracket 202 and the gate opening plate 206 in the upward direction D1, the wedge surface 212 of the gate opening plate 206 engages with the one or more gate locking pins 248, 250 to move the one or more gate locking pins 248, 250 to the unlocked state.

As shown in FIG. 4A, the wedge surface 212 of the gate opening plate 206 first engages with the second gate locking pin 250 and causes the second gate locking pin 250 to move to the unlocked state. Specifically, the wedge surface 212 engages with the second bar member 254 and pushes the second bar member 254 away from the plate 228 that causes the second spring member 266 to compress, thereby retracting the second gate locking pin 250 to the unlocked state. Further, upon subsequent movement of the gate opening plate 206 in the upward direction D1, the wedge surface 212 of the gate opening plate 206 engages with the first gate locking pin 248 and causes the first gate locking pin 248 to move to the unlocked state. Specifically, the wedge surface 212 engages with the first bar member 252 and pushes the first bar member 252 away from the plate 228 that causes the second spring member 264 to compress, thereby retracting the first gate locking pin 248 to the unlocked state.

Referring now to FIG. 4B, when the gate locking pins 248, 250 are in the unlocked state, the gate locking pins 248, 250 at least partially project from the corresponding first member 258. Further, upon subsequent movement of the gate opening plate 206 in the upward direction D1, a surface defined by the cut-out 214 of the gate opening plate 206 engages with the gate 230 to move the gate 230 to the open position. Specifically, the movement of the gate opening plate 206 in the upward direction D1 causes the gate opening plate 206 to engage with the gate 230 and move the gate 230 against a biasing force of the first spring member 244 (see FIG. 3A), thereby causing the gate 230 to move in the clockwise direction C1. Further, upon continued movement of the gate opening plate 206 in the upward direction D1, the gate 230 is disposed in the open position.

The gate 230 is illustrated in the open position in FIG. 5. Referring now to FIG. 5, as the gate opening plate 206 continuously moves upwards, the gate 230 is open wide enough for the hose bracket 202 and the hoses 120, 122 to pass through the central opening 224 of the hose retention member 226. Further, the gate 230 is movable in the clockwise direction C1 until the second surface 238 of the gate 230 engages with the stopper 242. Thus, the stopper 242 limits any further movement of the gate 230 in the clockwise direction C1. Further, when the gate 230 is disposed in the open position after moving in the clockwise direction C1, the first projection 236 of the gate 230 at least partially aligns with the first gate locking pin 248 to prevent a movement of the first gate locking pin 248 to the locked state. Specifically, the first projection 236 of the gate 230 prevents the first gate locking pin 248 from projecting out of the plate 228 in order to facilitate return of the gate 230 to the closed position. Once the hose bracket 202 and the hoses 120, 122 have passed through the central opening 224 of the hose retention member 226, the gate 230 moves to the closed position, and the gate locking pin 248 followed by the gate locking pin 250 in sequence moves towards the locked position.

Figure 6A:
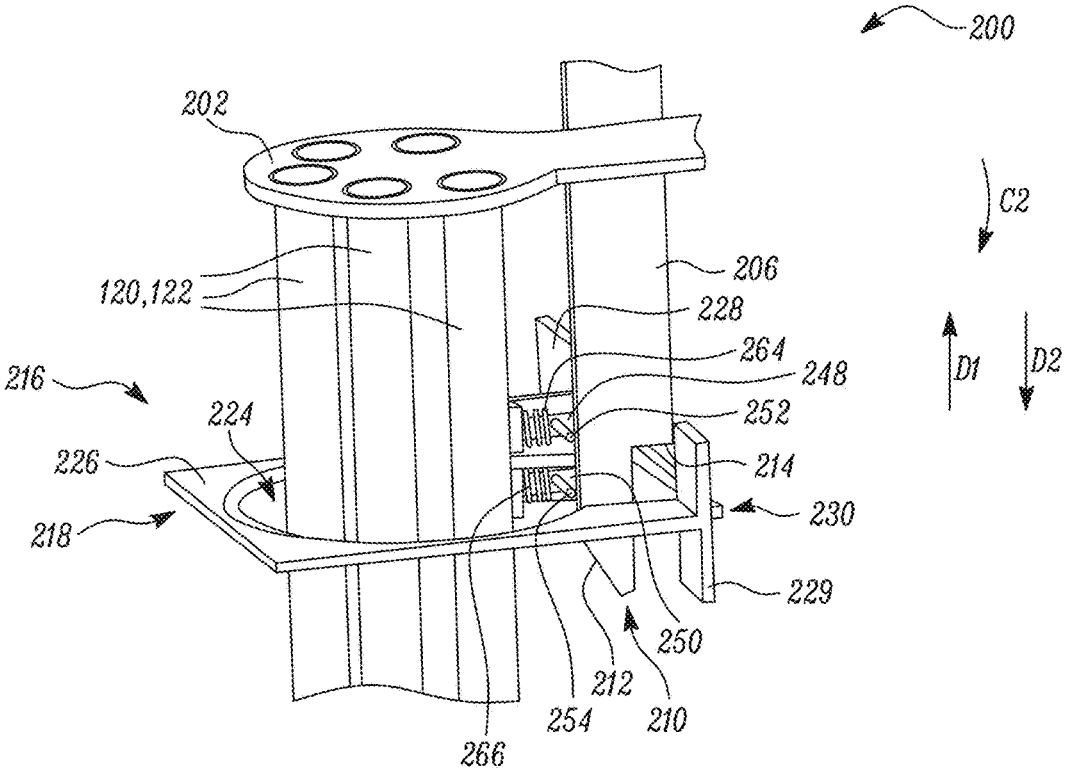
FIGS. 6A and 6B are schematic perspective views illustrating the contact of the gate opening plate with the hose retention system of FIG. 3A during a downward movement of the gate opening plate.
Figure 6B:
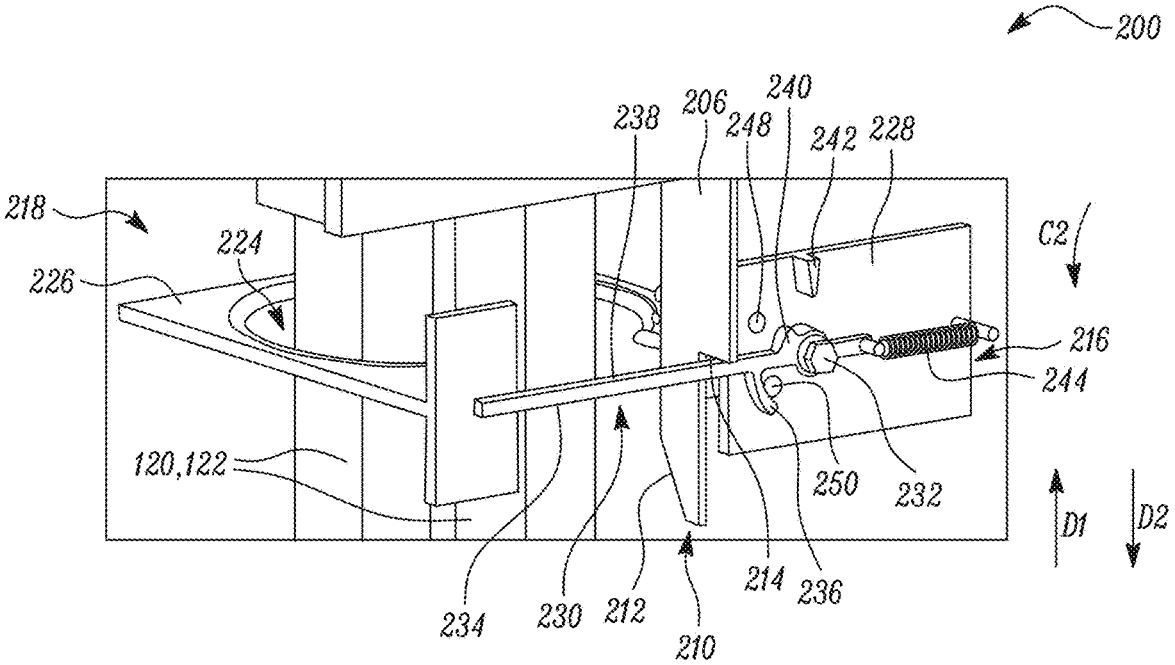

Referring now to FIGS. 6A and 6B, during the movement of the hose bracket 202 and the gate opening plate 206 in the downward direction D2, the wedge surface 212 of the gate opening plate 206 engages with the one or more gate locking pins 248, 250 to move the one or more gate locking pins 248, 250 to the unlocked state. The wedge surface 212 of the gate opening plate 206 first engages with the first gate locking pin 248 and causes the first gate locking pin 248 to move to the unlocked state. Specifically, the wedge surface 212 engages with the first bar member 252 and pushes the first bar member 252 away from the plate 228 that causes the second spring member 264 to compress thereby retracting the first gate locking pin 248 to the unlocked state. Further, upon subsequent movement of the gate opening plate 206 in the downward direction D2, the wedge surface 212 of the gate opening plate 206 engages with the second gate locking pin 250 and causes the second gate locking pin 250 to move to the unlocked state. Specifically, the wedge surface 212 engages with the second bar member 254 and pushes the second bar member 254 away from the plate 228 that causes the second spring member 266 to compress thereby retracting the second gate locking pin 250 to the unlocked state.

Referring now to FIG. 6B, a surface defined by the cut-out 214 of the gate opening plate 206 engages with the gate 230 to move the gate 230 to the open position. Specifically, the movement of the gate opening plate 206 in the downward direction D2 causes the gate opening plate 206 to engage with and move the gate 230 against the biasing force of the first spring member 244, thereby causing the gate 230 to move in the anti-clockwise direction C2. Further, upon continued movement of the gate opening plate 206 in the downward direction D2, the gate 230 is disposed in the open position.

Figure 7:
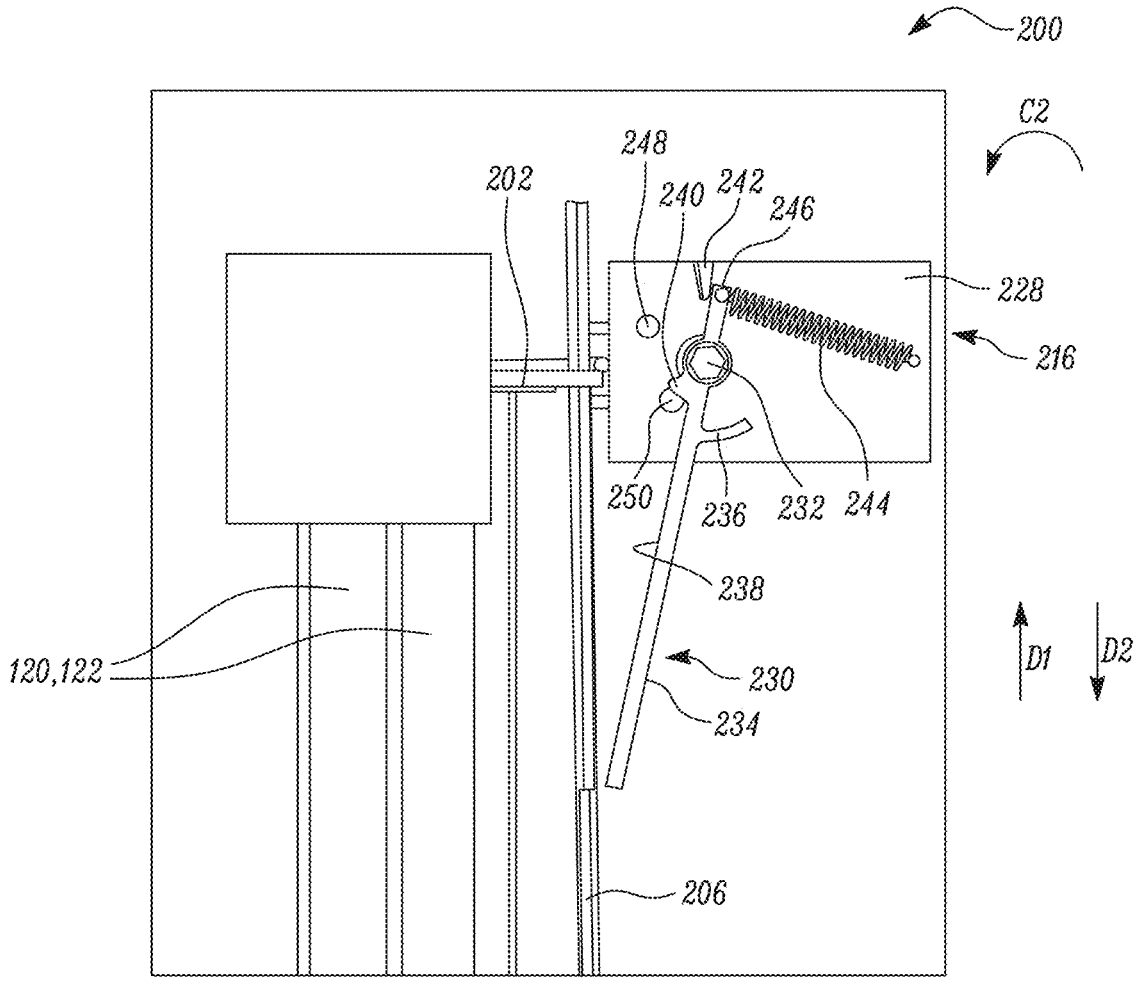
FIG. 7 is a schematic perspective view illustrating the gate of the hose retention system of FIG. 3A in the open position based on a movement of the gate in an anti-clockwise direction.

The gate 230 is illustrated in the open position in FIG. 7. Referring now to FIG. 7, as the gate opening plate 206 continuously moves downwards the gate 230 is open wide enough for the hose bracket 202 and the hoses 120, 122 to pass through the hose retention member 226 (see FIG. 6B). Further, the gate 230 is movable in the anti-clockwise direction C2 until the second surface 238 of the gate 230, proximal to the end 246, engages with the stopper 242. Thus, the stopper 242 limits any further movement of the gate 230 in the anti-clockwise direction C2. Further, when the gate 230 is disposed in the open position after moving in the anti-clockwise direction C2, the second projection 240 of the gate 230 at least partially aligns with the second gate locking pin 250 to prevent a movement of the second gate locking pin 250 to the locked state. Specifically, the second projection 240 of the gate 230 prevents the second gate locking pin 250 from projecting out of the plate 228 in order to facilitate return of the gate 230 to the closed position. Once the hose bracket 202 and the hoses 120, 122 have passed through the central opening 224 of the hose retention member 226, the gate 230 moves to the closed position, and the gate locking pin 250 followed by the gate locking pin 248 in sequence moves towards the locked position.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure is directed towards the hose assembly 200 including the hose retention systems 216. The hose retention systems 216 of the hose assembly 200 provide a means to secure the hoses 120, 122 and/or cables associated with the machine 100 along their length due to which such hoses 120, 122 and/or cables may be restricted to move or oscillate during drilling operations. The hose retention systems 216 may limit the movement of the hoses 120, 122 which may prevent contact and/or entanglement of the hoses 120, 122 with other components of the machine 100. Thus, the hose retention system 216 may prevent any damage to the components of the machine 100 by avoiding inadvertent contact with the hoses 120, 122.

Further, the hose retention systems 216 may promote stability of the hoses 120, 122 and may prevent rupturing of the hoses 120, 122, for example, during high velocity winds or during the movement of the hoses 120, 122 along the mast assembly 106. Thus, the hose retention system 216 may eliminate machine downtime and maintenance costs that may be otherwise encountered due to rupturing of the hoses 120, 122 or machine components.

The hose assembly 200 includes multiple hose retention systems 216 disposed along the height H1 of the mast assembly 106 thereby allowing the hoses 120, 122 to be securely held and enclosed on all four sides, as the hoses 120, 122 move along the height H1 of the mast assembly 106. The hose retention systems 216 may also guide the hoses 120, 122 along the mast assembly 106. The hose retention member 226 of each hose retention system 216 includes smooth and rounded interior surfaces to reduce friction between the hoses 120, 122 and the hose retention member 226. The gate 230 of each hose retention system 216 opens based on a contact of the gate 230 with the gate opening plate 206. Further, the gate 230 moves to the closed position under the action of the first spring member 244, while retaining/trapping the hoses 120, 122 within the hose retention member 226. The hose retention system 216 further includes the first and second projections 236, 240 that may prevent inadvertent movement of the corresponding gate locking pins 248, 250 towards the locked state, when the gate 230 is in the open position.

The hose retention systems 216 described herein may be simple and robust in construction, and may be cost-effective. Further, the hose retention systems 216 may be used with various types of drilling machines or any other machine that includes hoses or cables. Moreover, the hose retention system 216 described herein may be retrofitted on exiting machines.

While aspects of the present disclosure have been particularly shown and described with reference to the embodiments above, it will be understood by those skilled in the art that various additional embodiments may be contemplated by the modification of the disclosed work machine, systems and methods without departing from the spirit and scope of the disclosure. Such embodiments should be understood to fall within the scope of the present disclosure as determined based upon the claims and any equivalents thereof.

What is claimed is:

1. A hose retention system for a machine, the hose retention system comprising:

a bracket assembly defining a first end, a second end opposite the first end, and a central opening;

a gate coupled to the bracket assembly at the first end of the bracket assembly, the gate being movable between a closed position and an open position, wherein the gate is disposed in the open position to allow passage of one or more hoses of the machine through the central opening of the bracket assembly, and wherein, to be disposed in the open position, the gate is movable in a clockwise direction and an anti-clockwise direction;

a first gate locking pin coupled to the bracket assembly and movable between a first unlocked state and a first locked state;

a second gate locking pin coupled to the bracket assembly and movable between a second unlocked state and a second locked state;

wherein the gate is movable in the clockwise direction with the first gate locking pin in the first unlocked state and the second gate locking pin in the second locked state; and wherein the gate is movable in the anti-clockwise direction with the first gate locking pin in the first locked state and the second gate locking pin in the second unlocked state.

2. The hose retention system of claim 1, wherein the bracket assembly includes a hose retention member defining the central opening and a plate coupled to the hose retention member at the first end of the bracket assembly, wherein the plate extends orthogonally relative to the hose retention member, and wherein the gate is rotatably coupled to the plate of the bracket assembly.

3. The hose retention system of claim 2, further comprising a first spring member disposed between the plate and one end of the gate to bias the gate to the closed position.

4. The hose retention system of claim 2, further comprising a stopper coupled to the plate to prevent a movement of the gate beyond a predetermined angular distance in each of the clockwise direction and the anti-clockwise direction.

5. The hose retention system of claim 4, wherein the gate includes:

a first surface;

a first projection extending from the first surface of the gate;

a second surface opposite the first surface, wherein the stopper is adapted to engage with the second surface of the gate to prevent the movement of the gate beyond the predetermined angular distance in the clockwise direction and the stopper is adapted to engage with the second surface proximal to an end of the gate to prevent the movement of the gate beyond the predetermined angular distance in the anti-clockwise direction; and a second projection extending from the second surface of the gate.

6. The hose retention system of claim 5, wherein when the gate is disposed in the open position after moving in the clockwise direction, the first projection of the gate at least partially aligns with the first gate locking pin to prevent a movement of the first gate locking pin to the first locked state and when the gate is disposed in the open position after moving in the anti-clockwise direction, the second projection of the gate at least partially aligns with the second gate locking pin disposed parallel to the first gate locking pin to prevent a movement of the second gate locking pin to the second locked state.

7. The hose retention system of claim 1, further comprising at least one second spring member coupled to the first gate locking pin to bias the first gate locking pin to the first locked state.

8. The hose retention system of claim 1, wherein the machine includes a hose bracket to hold the one or more hoses and a gate opening plate coupled to the hose bracket, and wherein the gate opening plate is adapted to engage with each of the first and second gate locking pins to move the first and second gate locking pins to the first and second unlocked state and the gate to move the gate to the open position.

9. A hose assembly for a machine, the hose assembly comprising:

a hose bracket;

a gate opening plate coupled to the hose bracket;

one or more hoses coupled to the hose bracket; and at least one hose retention system including:

a bracket assembly defining a first end, a second end opposite the first end, and a central opening;

a gate coupled to the bracket assembly at the first end of the bracket assembly, the gate being movable between a closed position and an open position, wherein the gate is disposed in the open position to allow passage of the one or more hoses through the central opening of the bracket assembly, and wherein, to be disposed in the open position, the gate is movable in any one of a clockwise direction and an anti-clockwise direction; and at least one gate locking pin coupled to the bracket assembly, wherein the at least one gate locking pin is movable between a locked state and an unlocked state, wherein, in the locked state, the at least one gate locking pin prevents a movement of the gate to the open position, and wherein, in the unlocked state, the at least one gate locking pin allows a movement of the gate to the open position, wherein the gate opening plate engages with each of the at least one gate locking pin to move the at least one gate locking pin to the unlocked state and the gate to move the gate to the open position.

10. The hose assembly of claim 9, wherein the bracket assembly includes a hose retention member defining the central opening and a plate coupled to the hose retention member at the first end of the bracket assembly, wherein the plate extends orthogonally relative to the hose retention member, and wherein the gate is rotatably coupled to the plate of the bracket assembly.

11. The hose assembly of claim 10, wherein the at least one hose retention system further includes a first spring member disposed between the plate and one end of the gate, to bias the gate to the closed position.

12. The hose assembly of claim 10, wherein the at least one hose retention system further includes a stopper coupled to the plate to prevent a movement of the gate beyond a predetermined angular distance in each of the clockwise direction and the anti-clockwise direction.

13. The hose assembly of claim 12, wherein the gate includes:

a first surface;

a first projection extending from the first surface of the gate;

a second surface opposite the first surface, wherein the stopper is adapted to engage with the second surface of the gate to prevent the movement of the gate beyond the predetermined angular distance in the clockwise direction and the stopper is adapted to engage with the second surface proximal to an end of the gate to prevent the movement of the gate beyond the predetermined angular distance in the anti-clockwise direction; and a second projection extending from the second surface of the gate.

14. The hose assembly of claim 13, wherein the at least one gate locking pin includes:

a first gate locking pin, wherein, when the gate is disposed in the open position after moving in the clockwise direction, the first projection of the gate at least partially aligns with the first gate locking pin to prevent a movement of the first gate locking pin to the locked state; and a second gate locking pin disposed parallel to the first gate locking pin, wherein, when the gate is disposed in the open position after moving in the anti-clockwise direction, the second projection of the gate at least partially aligns with the second gate locking pin to prevent a movement of the second gate locking pin to the locked state.

15. The hose assembly of claim 9, wherein the at least one hose retention system further includes at least one second spring member coupled to the at least one gate locking pin to bias the at least one gate locking pin to the locked state.

16. The hose assembly of claim 9, wherein the gate opening plate defines a pair of opposing ends, wherein the gate opening plate defines a wedge surface and a cut-out at each opposing end, wherein the wedge surface of the gate opening plate is adapted to engage with the at least one gate locking pin to move the at least one gate locking pin to the unlocked state, and wherein the cut-out of the gate opening plate is adapted to engage with the gate to move the gate to the open position.

17. A machine comprising:

a mast assembly;

one or more hoses coupled to the mast assembly; and at least one hose retention system coupled to and extending from the mast assembly, the at least one hose retention system including:

a bracket assembly defining a first end, a second end opposite the first end, and a central opening;

a gate coupled to the bracket assembly at the first end of the bracket assembly, the gate being movable between a closed position and an open position, wherein the gate is disposed in the open position to allow passage of the one or more hoses through the central opening of the bracket assembly, and wherein, to be disposed in the open position, the gate is movable in any one of a clockwise direction and an anti-clockwise direction; and at least one gate locking pin coupled to the bracket assembly, wherein the at least one gate locking pin is movable between a locked state and an unlocked state, wherein, in the locked state, the at least one gate locking pin prevents a movement of the gate to the open position, and wherein, in the unlocked state, the at least one gate locking pin allows a movement of the gate to the open position;

a hose bracket to hold the one or more hoses; and a gate opening member coupled to the hose bracket, wherein the gate opening member is adapted to engage with each of the at least one gate locking pin to move the at least one gate locking pin to the unlocked state and the gate to move the gate to the open position.

18. The machine of claim 17, wherein the at least one hose retention system includes a plurality of hose retention systems spaced apart from each other along a height of the mast assembly, wherein the plurality of hose retention systems are in alignment with each other.

19. The machine of claim 17, wherein the gate opening member defines a pair of opposing ends, wherein the gate opening member defines a wedge surface and a cut-out at each opposing end, wherein the wedge surface of the gate opening member is adapted to engage with the at least one gate locking pin to move the at least one gate locking pin to the unlocked state, and wherein the cut-out of the gate opening member is adapted to engage with the gate to move the gate to the open position.

* * * * *